US009343046B2

(12) United States Patent
Fletcher

(10) Patent No.: US 9,343,046 B2
(45) Date of Patent: May 17, 2016

(54) STRINGED MUSICAL INSTRUMENT WITH SURFACE MOUNTED NECK INSERT

(71) Applicant: Scott James Fletcher, Belfair, WA (US)

(72) Inventor: Scott James Fletcher, Belfair, WA (US)

( * ) Notice: Subject to any disclaimer, the term of this patent is extended or adjusted under 35 U.S.C. 154(b) by 0 days.

(21) Appl. No.: 14/218,828

(22) Filed: Mar. 18, 2014

(65) Prior Publication Data

US 2014/0260887 A1 Sep. 18, 2014

Related U.S. Application Data

(60) Provisional application No. 61/794,528, filed on Mar. 15, 2013.

(51) Int. Cl.
*G10D 3/06* (2006.01)
*G10D 1/08* (2006.01)

(52) U.S. Cl.
CPC .. *G10D 3/06* (2013.01); *G10D 1/08* (2013.01); *Y10T 29/49574* (2015.01)

(58) Field of Classification Search
CPC ..... G10D 3/06; G10D 1/08; G10D 1/085; G10D 1/00; G10D 3/10
USPC ..... 84/267, 290, 293
See application file for complete search history.

(56) References Cited

U.S. PATENT DOCUMENTS 3,143,028 A 8/1964 Fender
4,137,813 A 2/1979 Stone et al.
5,864,073 A 1/1999 Carlson
8,324,489 B1 * 12/2012 Chapman ..... 84/314 R
2013/0340591 A1 * 12/2013 Koszegfalvi ..... 84/293

OTHER PUBLICATIONS

Gary Kramer Guitar Company, Brochure for "Bondage" Model Guitars with inlaid fretboard in the neck, published at least as early as 2009, 2 pages.

Gary Kramer Guitar Company, photos of guitars with inlaid fretboard in the neck, the guitars were displayed to the public and on sale to the public at least as early as 2009, 15 pages.

* cited by examiner

*Primary Examiner* — Kimberly Lockett
(74) *Attorney, Agent, or Firm* — Seed IP Law Group PLLC

(57) ABSTRACT

A stringed musical instrument with a base portion and neck portion with an inlaid fretboard snugly secured within a recess between an upper wall and a lower wall on the neck portion is disclosed. The geometry of the upper and lower walls maybe optimized and includes walls that are substantially perpendicular to the face of the instrument, walls that are angled with respect to each other to define a wedge-shaped slot for slidably receiving and securing the mating fretboard therein, and walls that are angled to define inwardly extending protrusions that allow the fretboard to be "snapped" in place on the neck portion of the instrument. The fretboard may be rigidly secured to the neck portion with glue or the like or it may be detachably secured within the slot thereby allowing fretboards to be changed as desired for aesthetic or performance purposes.

16 Claims, 5 Drawing Sheets

STRINGED MUSICAL INSTRUMENT WITH SURFACE MOUNTED NECK INSERT

CROSS REFERENCE TO RELATED APPLICATION

This application claims priority to U.S. provisional patent application Ser. No. 61/794,528 filed on Mar. 15, 2013, the disclosure of which is hereby incorporated by reference.

FIELD OF THE INVENTION

The present invention relates to guitar necks and methods for making them. In particular, a fretboard may be operably secured between walls formed in the guitar neck to enhance playability, durability, and appearance of the guitar and to improve manufacturing efficiency.

SUMMARY

Bound guitar necks are common. Binding on a guitar neck enhances the playability of a guitar and contributes to the look and feel of the guitar with a desirable decorative embellishment. Binding is often found on the necks of high-end guitars that are sold for premium prices.

During construction of a traditional bound guitar neck, the edges along the length of the unfinished guitar neck and fretboard are removed by machining. A binding, usually consisting of plastic or wooden strips, is then glued to the neck and machined and sanded to appropriate tolerances. This process of binding a guitar neck in this manner is both time-consuming and labor intensive, thereby increasing the cost of the guitar. In addition, the binding material may have coefficients of expansion that differ from the coefficient of expansion of the neck material. This can lead to separation and/or cracking of the binding material. Further, plastic binding material can become loosened from the guitar neck and/or may deteriorate over time. Also, plastic binding materials are subject to becoming discolored over time.

SUMMARY

The advantages and features of novelty characterizing aspects of the invention are pointed out with particularity in the appended claims. To gain an improved understanding of the advantages and features of novelty, however, reference may be made to the following descriptive matter and accompanying figures that describe and illustrate various configurations and concepts related to the invention.

Rather than removing material from the edge of the guitar neck and replacing it with a binding strip as known in the art, disclosed embodiments of the present invention provide a look and feel of a bound guitar neck by inserting a fretboard into a recess between upper and lower walls of the neck portion of the instrument. The integral nature of the walls eliminate the need for binding materials for securing the fretboard to the neck portion and provide a more durable and more aesthetically instrument.

The geometry of the upper and lower walls may be optimized to define a wedge-shaped slot for slidably receiving and securing the mating fretboard therein. Alternatively, the walls may provide inwardly extending protrusions that allow the fretboard to be "snapped" in place on the neck portion of the instrument. The fretboard may be rigidly secured to the neck portion with glue or the like or it may be detachably secured within the slot, thereby allowing fretboards to be changed as desired for aesthetic or performance purposes.

FIGURE DESCRIPTIONS

The foregoing Summary and the following Detailed Description will be better understood when read in conjunction with the accompanying figures.

DETAILED DESCRIPTION

Figure 8:
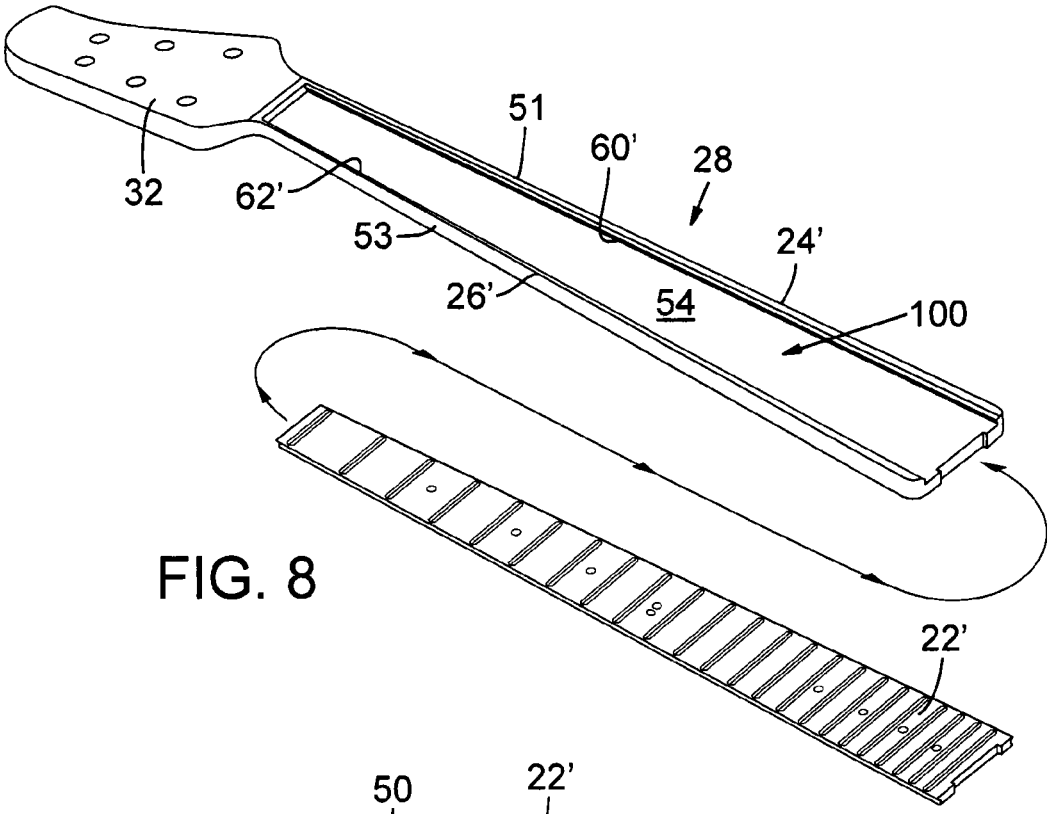
FIG. 8 is an isometric view of the neck portion of FIG. 6 showing a possible fretboard insert installation thereto.
Figure 9A:
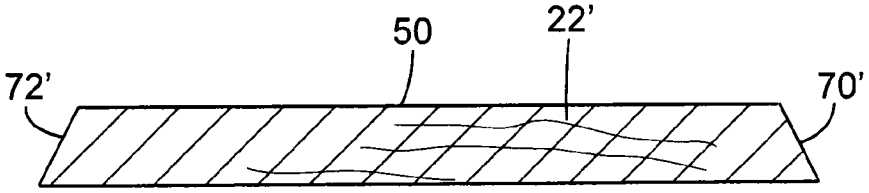
FIG. 9A is a cross-sectional view of a first possible fretboard having a substantially planar top surface with upper and lower edges that are operably engageable with the angled upper and lower walls of the neck portion of FIG. 6.
Figure 9B:
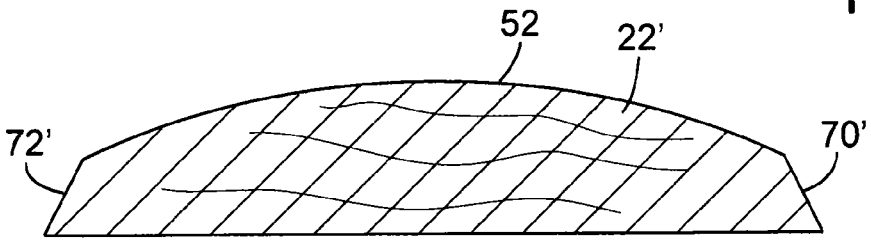
FIG. 9B is a cross-sectional view of a second possible fretboard having a substantially curved top surface with upper and lower edges that are operably engageable with the angled upper and lower walls of the neck portion of FIG. 6.
Figure 9C:
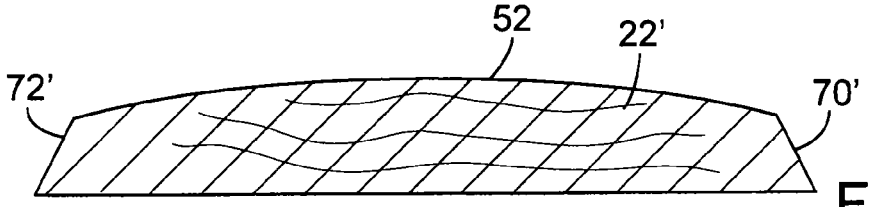
FIG. 9C is a cross-sectional view of a third possible fretboard having a small curved top surface with upper and lower edges that are operably engageable with the angled upper and lower walls of the neck portion of FIG. 6.
Figure 10A:
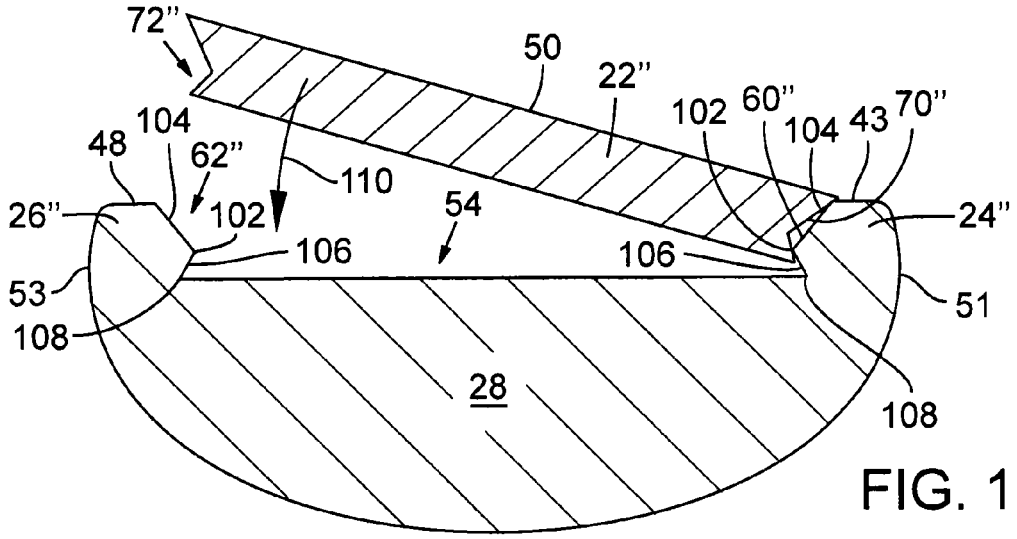
FIG. 10A is a cross-sectional view of a second alternative possible neck portion of a stringed-instrument with an insert operably secured thereto showing an alternative possible wall configuration in accordance with an embodiment of the present invention and with the insert in a possible detached position relative to the neck portion.
Figure 10B:
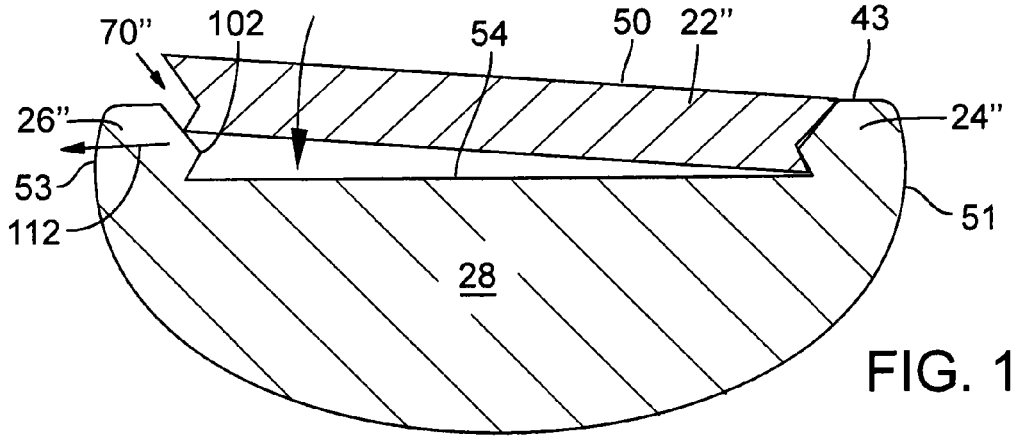
FIG. 10B is a cross-sectional view of the neck portion and fretboard insert of FIG. 10A showing a possible movement toward from an uninstalled to an installed position of the insert between the walls of the neck-portion.
Figure 10C:
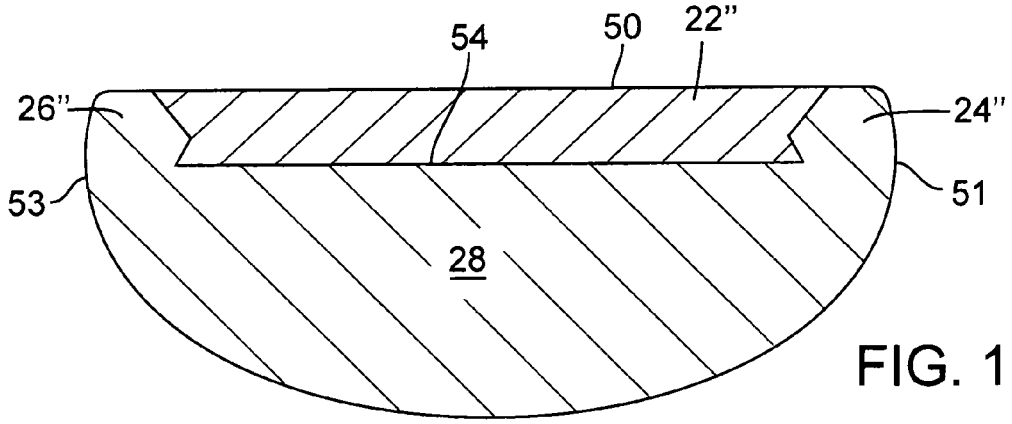
FIG. 10C is a cross-sectional view of the neck portion and fretboard insert of FIG. 10A showing a possible installed position of the insert between the walls of the neck portion.

A stringed-instrument 20, such as a guitar or the like, having a fretboard 22 insert operably received between a longitudinal upper wall 24 and a longitudinal lower wall 26 extending along the edges of the neck portion 28 of the stringed-instrument is shown in FIGS. 1-10C. A first possible embodiment is shown in FIGS. 1-5, a second possible embodiment is shown in FIGS. 6-9C, and a third possible embodiment is shown in FIGS. 10A to 10C.

Referring to FIGS. 1-5, the stringed-musical instrument 20, here a guitar is shown. Such instruments typically include a body portion 30 with the neck portion 28 extending therefrom thereby defining a longitudinal length 32 of the instrument 20. A head stock portion 32 is positioned toward the distal end 34 of the neck portion 28.

Strings 34, usually six, extend from the head stock portion 32 toward the body portion 30 along the longitudinal length 32 of the instrument 20. The strings 34 are held in tension between a nut 36 mounted toward the head stock portion 32 and a bridge 38 mounted on the base portion 30, and they are tuned by adjusting their tension using tuning pegs 40 positioned in the head stock portion 32.

The body portion 30 can include a hollow that allows the air within to resonate with vibrations from the strings when plucked or strummed thereby amplifying the sound produced by the strings of the instrument. This type of guitar is commonly referred to as an acoustic guitar. Alternatively, one or more electronic pickups 42 may be provided to allow collection and amplification of the sound produced. This type of guitar is commonly referred to as an electric guitar.

If desired, one or more stabilizing and adjustable truss rods 44 (FIG. 5) may be operably received within an interior portion of the neck portion 28 to improve rigidity and durability of the neck portion 28 of the instrument 20. Such stabilizing rods 44 and their uses are described in U.S. Pat. No. 3,143,028, the disclosure of which is hereby incorporated by reference. Other materials have also been positioned within the neck portion to improve neck portion rigidity. For example, U.S. Pat. No. 5,864,073, the disclosure of which is hereby incorporated by reference, teaches laminating a strip of graphite into an interior portion of the neck portion.

Figure 1:
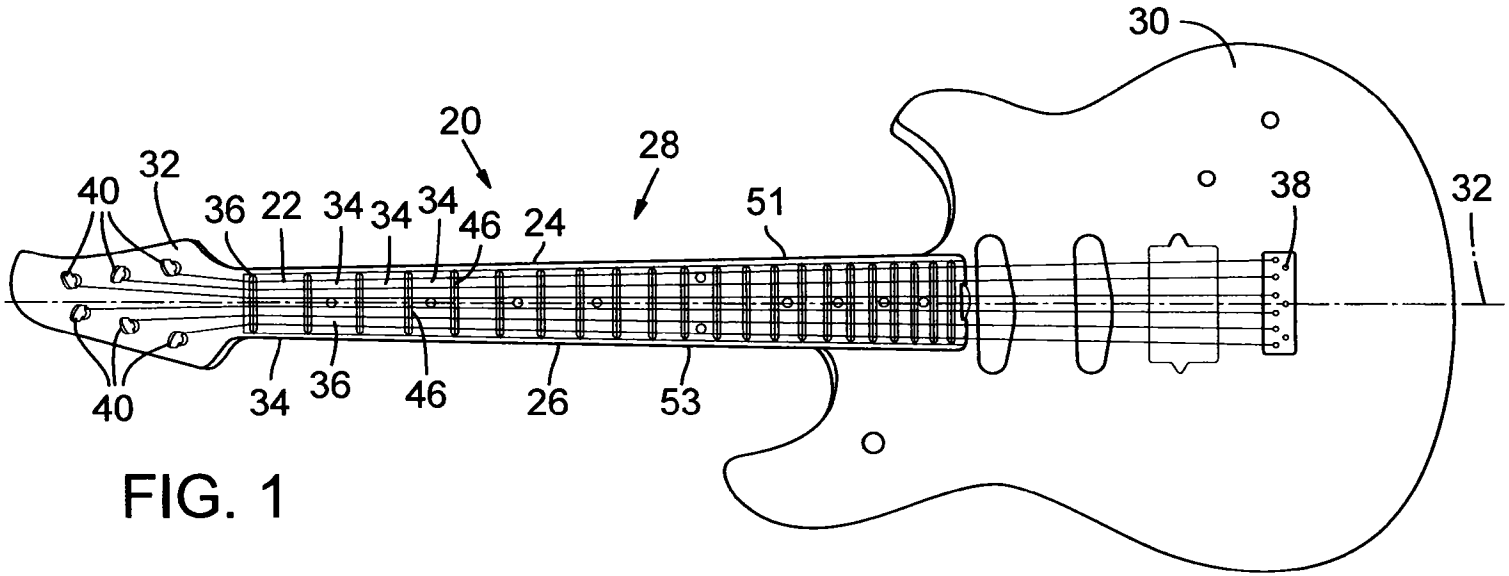
FIG. 1 is a front view of a stringed-instrument showing a possible substantially planar insert operably received between upper and lower walls in a neck portion thereof in accordance with an embodiment of the present invention.
Figure 2:
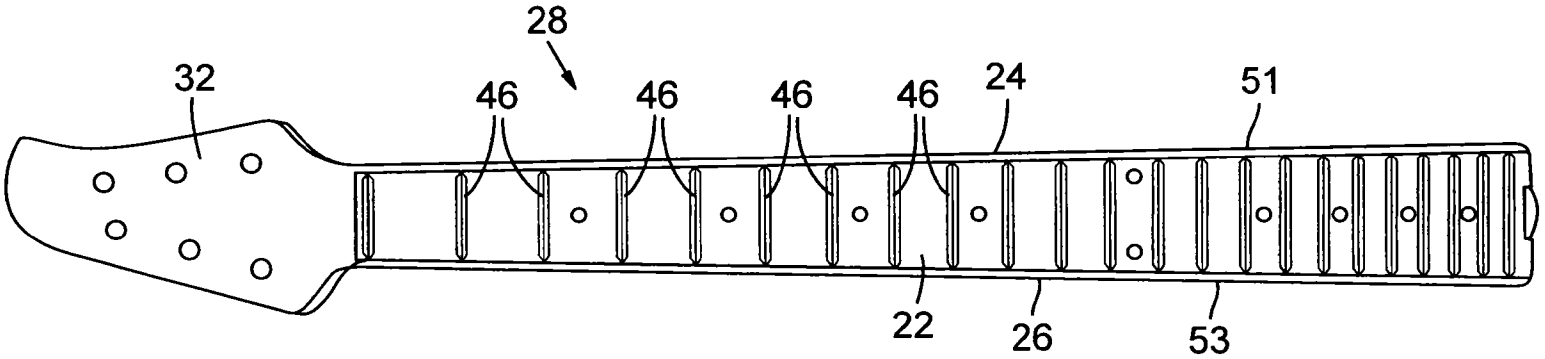
FIG. 2 is a front view of the neck portion of the stringed-instrument of FIG. 1.
Figure 3:
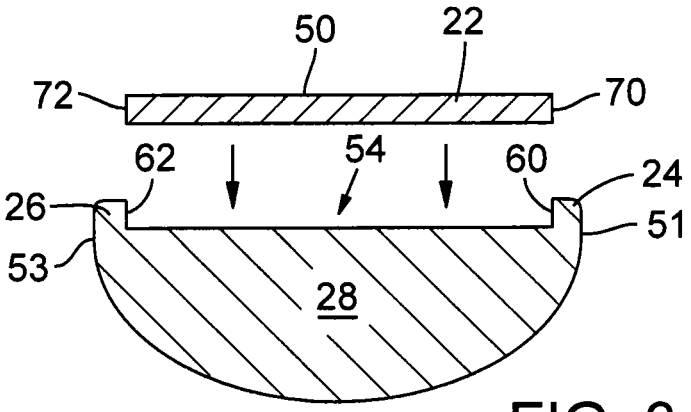
FIG. 3 is an exploded cross-sectional view of the neck portion of FIG. 2 taken along line 3-3 of FIG. 2.
Figure 6:
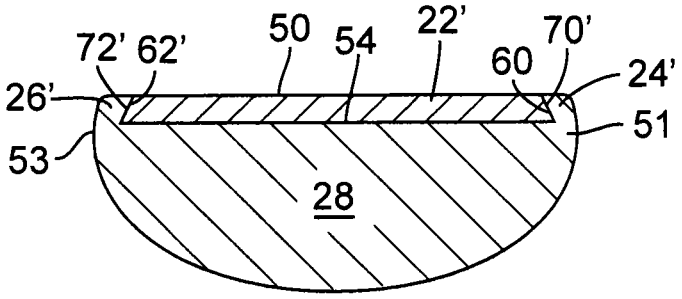
FIG. 6 is a cross-sectional view of an alternative possible neck portion of a stringed-instrument with a fretboard insert operably secured thereto showing an alternative possible wall configuration in accordance with an embodiment of the present invention.

A fretboard 22 containing a plurality if individual frets 46 is positioned on the outer face surface 48 of the neck portion 28 facing the strings 34. The fretboard 22 may be formed of another material than that of the neck portion 28. The fretboard 22 can be made of wood, plastic, metal or the like for desired aesthetic and acoustic benefits. Exemplar woods include ebony, rosewood, maple and the like. They may also be made with non-traditional materials such as plastic, aluminum, steel and the like. Fretboards 22 can have a substantially flat outer surface 50 as shown in FIGS. 3, 6, and 9A. Alternatively, fretboards may have a curved outer surface 52 as shown in FIGS. 9B and 9C.

Figure 4:
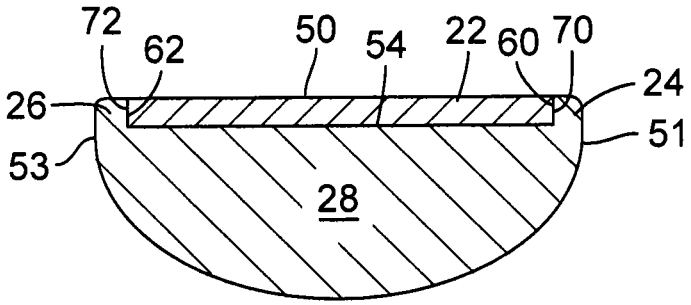
FIG. 4 is a cross-sectional view of the neck portion of FIG. 2 taken along line 4-4 of FIG. 2.
Figure 5:
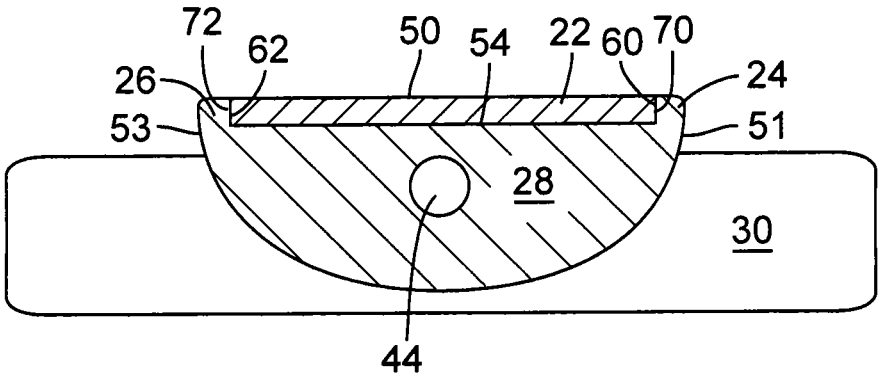
FIG. 5 is a cross-sectional view of the neck portion of FIG. 1 taken along line 5-5 of FIG. 1.

As shown in FIGS. 3-5, the neck portion 28 of the instrument 20 can be machined to form an upper wall 24 and a lower wall 26 along the exterior upper side 51 and lower side 53, respectively, and thereby define a recess 54 along the longitudinal length 32 of the instrument 20. The neck portion 28 can be made from any suitable wood, such as maple, mahogany, cedar, rosewood or other suitable woods. And the machining can be accomplished with conventional tools and processes such as routing equipment or the like. The walls 24, 26 have interior sides 60, 62 respectively, that are substantially perpendicular to the outer face surface 48 as best shown in FIG. 5.

The fretboard 22 is sized and shaped to be tightly and operably received within the recess 54 and between the walls 24, 26. The upper edge 70 and lower edge 72 of the fretboard 28 are shaped to tightly engage the walls 24, 26, respectively.

The fretboard 22 is inset into the recess 54, positioned between the upper and lower walls 24, 26, and secured in place preferably with glue or the like. Accordingly, the fretboard 28 is tightly constrained in the recess 54 by the upper and lower walls 24, 26 thereby eliminating the need for plastic or wooden binding materials to secure the fretboard 22 to the neck portion 28.

After the fretboard 22 is secured to the neck portion 28, the face of the fretboard is machine to the desired radius. A suitable finish is then applied to the neck portion 28 and frets 46 are secured onto the fretboard 22.

Inlaying the fretboard 22 into the recess 54 in the neck portion 28 creates a solid connection between the fretboard 22 and the neck portion 28 and eliminates the need for neck binding and associated pitfalls associated with traditional binding methods and construction. In addition, the inlaid fretboard as described provides a clean, one-piece look that eliminates contrast between the binding material and the wood of the neck portion. In addition, the walls provide additional strength to the neck portion 28.

Figure 7:
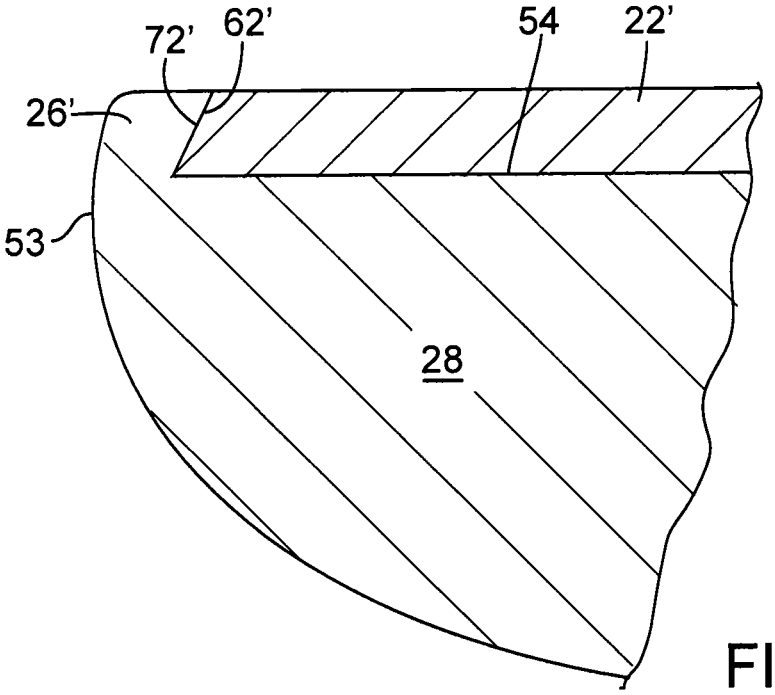
FIG. 7 is an enlarged, partial view of the alternative possible wall configuration of FIG. 6 that has been enlarged to show greater detail.

Referring to FIGS. 6 and 7, the interior sides 60', 62' of the upper and lower walls 24', 26' between the recess 54 of the neck portion 28 can define an angled or wedge shape that extends slightly inwardly as they extend toward the outer face surface 48 of the instrument 20. The upper and lower edges 70', 72' of the fretboard 22' are similarly angled so as to tightly mate with the angle of the upper and lower walls 24', 26' as best shown in FIG. 7.

Referring to FIG. 8, the fretboard 22' configured with mating wedge-shaped upper and lower edges 70', 72' can be secured to the neck portion 28 by sliding it into the recess 54 from the base side 80 toward the head stock portion 32 until the fretboard 22' is operably received within the walls 24', 26' and recess 54. It can appreciated that inserting the fretboard 22' in this manner allows a tapered neck portion and fretboard to be produced whereby the neck portion 28 and/or fretboard 22' may be narrower towards the head stock as shown.

After the fretboard 22 is inserted as described, the neck portion 28 may be operably secured to the base portion 30 thereby securing the fretboard 22 in place between a wall at the head stock portion 32 and a wall at the base portion. If desired, glue or other fasteners may also be added to the engaging surfaces between the underside of the fretboard and the neck portion to further hold the fretboard in position on the neck portion.

Referring to FIGS. 9A-9C, it can be appreciated that a variety of fretboard 22' shapes and styles may be inserted into the neck portion recess 54 between the walls 24, 26. The fretboard 22' may have a substantially flat face as shown in FIG. 9A. Or it may have a curved face as shown in FIGS. 9B and 9C, with a larger curve being shown in FIG. 9B.

It can be appreciated that the slot 100 (FIG. 8) defined by the recess 54 and wedge-shaped walls 24', 26' in the neck portion 28 allow a manufacturer to provide a common neck portion 28 and select from a variety of different fretboards 22' as needed by a particular customer. This allows the manufacturer to quickly and easily "customize" a particular instrument 20 for a particular customer.

Moreover, in cases where the installed fretboard 22' is detachably secured within the slot 100, a user or instrument servicer may easily remove and replace the fretboard 22' as desired or needed. For example, an instrument owner may change from a flat-faced fretboard 22' (FIG. 9A) to a curve-faced fretboard 22' (FIGS. 9B and 9C) simply by sliding the flat-faced fretboard 22' out of the slot and inserting a curve faced fretboard 22' into the open slot and reinstalling the neck portion 28 onto the base portion 30 of the instrument 20. Changing the material of the fretboard 22' and its surface ornamentation may also be accomplished in the same manner.

Referring to FIGS. 10A-10C, an alternative possible upper and lower wall 24", 26" shape is shown that allows a fretboard 22" with mating shaped upper and lower edges 70", 72" to be "snapped" into position on the neck portion 28. The upper and lower walls 24", 26" on the neck portion 28 have an angled protrusion 102 extending inwardly toward the recess 54 defining an upper angle 104 extending from the outer face surface 48 inward toward the protrusion 102 and a lower angle 106 extending from the protrusion 102 outward toward a lower edge 108 of the recess 54.

A fretboard 22" having mating upper and lower edges 70", 72" can be installed within the recess 54 and between the walls 24", 26" of the neck portion 28 by first positioning one edge 70" of the fretboard 22" between a protrusion 102 in the upper wall 24" of the neck portion 28 as shown in FIG. 10A. Then, urging the fretboard 22" in the direction of arrow 110 toward the opposing lower wall 26 as shown in FIG. 10B, and then applying pressure to slightly deflect the lower wall 26 outward in the direction of arrow 112 thereby "snapping" the fretboard 22" in place as shown in FIG. 10C when the lower edge of the fretboard 22" passes by the protrusion 102 in the lower wall 26 and the lower wall 26 returns to its neutral position.

One skilled in the relevant art will recognize that numerous variations and modifications may be made to the configurations described above without departing from the scope of the present invention, as defined by the appended claims.

What is claimed is:

1. A stringed musical instrument comprising;

a base portion having a face;

a neck portion extending from the base portion defining a longitudinal length of the instrument, the neck portion having an upper side and a lower side;

at least one string operably extending from the base portion to the neck portion above the face of the base portion;

the neck portion having a recess extending along the longitudinal length of the instrument defining an upper wall along the upper side of the neck portion and a lower wall along the lower side of the base portion, the upper wall and the lower wall having inwardly extending protrusions extending therefrom; and a fretboard operably secured within the recess between the upper wall and lower wall.

2. The stringed musical instrument of claim 1, wherein a portion of the upper wall and a portion of the lower wall are substantially perpendicular to the face of the base portion.

3. The stringed musical instrument of claim 2, wherein the fretboard has an upper edge and a lower edge and said edges tightly engage the upper and lower walls of the neck portion, respectively.

4. The stringed musical instrument of claim 1, wherein the upper wall and lower wall having interior sides adjacent to the recess and the interior sides are angled toward each other to define a wedge-shaped slot.

5. The stringed musical instrument of claim 4, wherein the fretboard has an upper edge and lower edge that define a wedge shape for operably engaging the wedge-shaped slot in the neck portion.

6. The stringed musical instrument of claim 1, wherein the fretboard has an upper edge and a lower edge, the upper edge having a recess for operably engaging the protrusion in the upper wall, the lower edge having a second recess for operably engaging the lower wall thereby operably securing the fretboard to the neck portion.

7. The stringed musical instrument of claim 1, wherein the fretboard is rigidly secured to the neck portion.

8. The stringed musical instrument of claim 7, wherein the fretboard is rigidly secured to the neck portion with glue.

9. The stringed musical instrument of claim 1, wherein the fretboard is detachably secured to the neck portion.

10. The stringed musical instrument of claim 1, wherein the stringed musical instrument is a guitar.

11. A method of making a stringed musical instrument comprising:

providing a base portion having a face;

providing a neck portion having a face, upper edge and lower edge;

forming a recess in the face of the neck portion defining an upper wall along the upper edge and a lower wall along the lower edge, the upper wall and the lower wall having inwardly extending protrusions extending therefrom;

providing a fretboard sized and shaped to fit snugly within the recess and between the upper and lower walls; and, operably securing the fretboard within the recess between the upper and lower walls.

12. The method of making a stringed musical instrument of claim 11, further including operably forming interior portions of the upper and lower walls that are substantially perpendicular to the face.

13. The method of making a stringed musical instrument of claim 11, further including operably forming interior portions of the upper and lower walls to define a wedge-shaped slot for operably receiving the fretboard therein.

14. The method of making a stringed musical instrument of claim 11, further including operably forming interior portion of the upper and lower walls to define upper and lower protrusions for operably holding the fretboard therein.

15. The method of making a stringed musical instrument of claim 11, wherein the step of providing a fretboard includes rigidly securing the fretboard in the recess between the upper and lower walls.

16. The method of making a stringed musical instrument of claim 11, wherein the step of providing a fretboard includes detachably securing a fretboard in the recess between the upper and lower walls.

* * * * *